United States Patent [19]

Nelsson

[11] 4,106,251

[45] Aug. 15, 1978

[54] RELOCATABLE WALL MOUNTING SYSTEM

[75] Inventor: Nels Nelsson, Des Plaines, Ill.

[73] Assignee: United States Gypsum Company, Chicago, Ill.

[21] Appl. No.: 580,454

[22] Filed: May 23, 1975

[51] Int. Cl.[2] ..... E04B 2/58; E04B 2/76

[52] U.S. Cl. ..... 52/765; 52/774; 52/775

[58] Field of Search ..... 52/498, 502, 349, 351, 52/354, 355–363, 760, 281, 391, 481, 489

[56] References Cited

U.S. PATENT DOCUMENTS

| | | | |
|---|---|---|---|
| 3,308,590 | 3/1967 | Ettore | 52/281 |
| 3,537,217 | 11/1970 | Lickliter | 52/481 |
| 3,623,290 | 11/1971 | Downing | 52/481 |
| 3,732,657 | 5/1973 | Nelsson | 52/481 |
| 3,732,660 | 5/1973 | Byssing | 52/509 |
| 3,753,325 | 8/1973 | Stanley | 52/481 |
| 3,759,001 | 9/1973 | Jadkins | 52/481 |
| 3,862,530 | 1/1975 | Martine | 52/281 |

FOREIGN PATENT DOCUMENTS

| | | | |
|---|---|---|---|
| 1,149,500 | 12/1957 | France | 52/509 |
| 392,825 | 10/1965 | Switzerland | 52/511 |

*Primary Examiner*—Price C. Faw, Jr.
*Assistant Examiner*—Henry Raduazo
*Attorney, Agent, or Firm*—Glenn W. Ohlson; Samuel Kurlandsky; Robert H. Robinson

[57] ABSTRACT

A relocatable wall mounting system is disclosed making use of a half-clip which, when mounted adjacent to a like half-clip at the abutting edges of wallboard panels, forms a spring clip attachment for engaging a slot in a support member to attach the panels to the support member. The half-clip has: a first shoulder section adaptable to be driven into the end of the wallboard panel; a base section extending from the shoulder section; a second shoulder section connected to the base section and extending in the direction of the end to be driven into the panel; and a curved spring arm extending outwardly and curving arcuately in the direction of the end to be driven into the panel.

3 Claims, 3 Drawing Figures

RELOCATABLE WALL MOUNTING SYSTEM

BACKGROUND OF THE INVENTION

1. Field of the Invention

This invention relates to a relocatable wall mounting system making use of a half-clip with the half-clip being driven into the edge of a wallboard panel and with the half-clip acting in conjunction with a second half-clip mounted adjacent thereto to form a spring for insertion into a slot in a support member thereby attaching the wallboard panels to the stud.

2. Description of the Prior Art.

Many wall mounting systems have been devised making use of a wide variation of systems for attaching wallboard panels to studs or the like in the construction of a finished wall surface. Of course, the more common of these is the simple nailing or screwing of the wallboard panel to the stud. The problem with this system of attachment, however, is that it requires finishing over the attachment device and also prevents or makes impossible its usage with wallboard panels having highly decorative prefinished surfaces, such as vinyl clad wallboard. Recognizing this need, the industry provided a number of systems for making the attachment of highly decorative wallboard panels to stud systems. For instance, U.S. Pat. No. 1,974,819 has a pronged insert which is inserted into the side of a wallboard and which has a shoulder on the back of the wallboard which slides into and engages a second device which is mechanically attached to the stud by screws or the like. This system is particularly undesirable because it requires an extra part which must be attached to a stud and also is very time consuming in requiring a connection of the two parts as well as in requiring attachment of the second device to the support structure.

On the other hand, U.S. Pat. No. 1,815,065 used a slotted stud with a clamp within the slot but once the T-grip which held the wallboard was inserted into the clamp it was locked therein and could not be removed for relocation of the wall. Still other prior systems, like that disclosed in U.S. Pat. No. 2,059,483, use two half-clips each attached to the back of a wallboard, but require a third half-clip to be inserted entirely through the wallboard at the mating surfaces thereof to spread apart the clip and make it useful for engaging a slotted stud. This system is not desirable in that the attachment to the wallboard defaces a decorative surface on the wallboard.

U.S. Pat. No. 1,697,456 uses a pronged insert for jamming into a board edge, but the projection therefrom is merely a straight flange which must be attached to the support structure by conventional means such as nails or screws. This is obviously time consuming and expensive and limits relocation of the wall without damage thereto. That product, however, is improved by a removable panel fastener such as the one disclosed in U.S. Pat. No. 3,308,590, but here again, this panel fastener requires the nailing of the fastener to the stud in order to secure the wallboard to the stud and this is time consuming, costly, and does not provide for removability of the wall.

While the use of half-clips is not in itself new, the novel embodiment shown herein is an advance over prior uses of half-clips. For instance, in Canadian Pat. No. 465,785, half-clips attach to the back of the panels and are inserted into slots in a stud, but these clips require hemispherical inserts therein and require the use of a ball and socket-type joint for securing of the clip to the stud. Once the ball and socket type joint is inserted into a spring design in the slot in the stud, the system is locked in and this lack of removability severely limits the system. U.S. Pat. No. 3,683,575, however, uses an insert into the side of the wall panel to prevent lateral movement of the wall panel, but outward movement of the wall panel is prevented solely by trim material at the top and bottom of the wall panel. This results in an inferior attachment system that does not have sufficient attachment for many rigid wall systems.

While U.S. Pat. No. 3,708,941 uses two non-clipping inserts which mate together to hang into an opening of a slotted stud, this design requires the kerfing of the panel, a more expensive design than is necessary for the use of the product of this invention. Perhaps the previously most advanced design making the use of half-clips is U.S. Pat. No. 2,734,126 which uses only a single half-clip to attach to a slotted stud, but requires the attachment of the half-clip to the back of the wall panel thereby providing a system which defaces a decorative surface on the face of the wall panel thus producing a highly undesirable system from an aesthetic standpoint.

The new and novel design of this invention provides a system which attaches readily to the wallboard without any special design thereof and which readily mounts the wallboard onto a slotted stud without any other type of preparation. The system provides a mounted wall which is highly decorative and which is simple and easy in its construction. The system also has the very important feature of being removable and relocatable, thus enhancing its value.

SUMMARY OF THE INVENTION

It is an object of this invention to removably attach wallboard panels to slotted support members.

It is a further object of this invention to mount wallboard panels by means of a clip to a slotted stud or other support member without damaging a decorative surface on the face of the wallboard panel. p It is a further object of this invention to provide a clip for mounting wallboard panels to a slotted stud without requiring nails, brads, screws, or the like, for attachment of the clip to either the wallboard panels or the stud.

It is a further object of this invention to provide a new and unique wall mounting.

It is a further object of this invention to provide a wall mounting system for mounting wallboard panels having decorative facings thereon without damage to the decorative faces.

The objects of this invention are accomplished by a half-clip which, when mounted adjacent to a like half-clip at the abutting edges of adjacent wallboard panels forms a spring clip attachment for engaging an opening in a support member to attach the panels to the support member, said half-clip comprising:

- a first shoulder section adapted to be the driven into the end of a wallboard panel;
- a base section extending substantially perpendicular from the first shoulder section at the edge opposite the end to be driven into the panel;
- a second shoulder section connected to the base section and extending substantially perpendicular to the base section and substantially parallel to and in the same direction as the first shoulder section; and
- a curved spring arm extending from the connection of the base section and the second shoulder section away from the first shoulder base section and curving arcuately outward in the direction of the end to be driven into the panel.

In one particularly acceptable embodiment of the above, the second shoulder section has the corners thereof bent inwards in order that the half-clip may grip the wallboard panels. In still another embodiment, the first shoulder section has one more prongs with points thereon to be driven into the end of the wallboard panel.

The objects of this invention are further accomplished by a relocatable unique wall mounting which comprises in combination, (1) a first panel having attached thereto, (2) a first half-clip, (3) a second panel having attached thereto, (4) a second half-clip, said first and said second half-clips characterized by having, (5) first shoulder sections adapted to be driven into the respective ends of the first panel and second panel to secure them thereto, (6) base sections extending from the first shoulder sections along the ends of the panels to the outer corners of the panels, (7) second shoulder sections extending beyond the base sections, said second shoulder section of said first half-clip extending along a back face of the first panel, and said second shoulder section of said second half-clip extending along a corresponding back face of the second panel, (8) curved spring arms extending arcuately from the base sections outward from the panels with the curved spring arms opposing one another to form a spring clip, and (9) a slotted support member for engaging the spring clip formed by mounting the first panel with the first half-clip thereon end-to-end adjacent to the second panel with the second half-clip thereon, thereby attaching the mounted panels to the slotted support member.

In one particularly successful adapation of the above wall mounting system the second shoulder sections of the half-clips are bent to engage the respective back faces of the panels.

Briefly stated, the half-clips of this invention have a shoulder surface such as a series of prongs which are driven into the end edge of a wallboard panel to engage the half-clip thereto and form a firm connection therewith. The design of the surface such as the number and size of the prongs must be such as to provide an effective means of holding the wallboard panels and is dependent upon the strength of the material used in the wallboard panel. While prongs are not mandatory, the use of prongs can readily eliminate the expensive kerfing step in the production of wallboard panels that has been required in prior usage of attachment systems. The prongs are connected to a base which travels along the remaining end edge of a wallboard panel to the back corner thereof. At the back corner, an extension of the base, substantially perpendicular to the base, extends along the back face of the wallboard panel, and this extension or shoulder may be bent inward toward the wallboard panel so that it may engage the wallboard panel for additional support of the clip. Thereafter, extending arcuately outward from the corner of the wallboard panel is a continuation of the shoulder section which forms a half-clip. When a like half-clip is mounted adjacent to the first half-clip and attached to an adjacent mating wallboard panel, the two half-clips act in conjunction to form a spring clip which, when inserted into a slot in a slotted stud, holds the wallboard panel thereto. As a additional usage of the clip, the half-clips may be placed on opposing edges or ends of the wallboard panels creating, in effect, a large clip with the wallboard panel acting as the back section of the clip with each half-clip being inserted into studs at the end of the wallboard panel thereby securing the wallboard panel to the stud. While this embodiment is not as desirable as the use of the half-clips mounted adjacent one to the other to act as a full spring, it nevertheless is a new and novel embodiment which has useful application in the building industry.

BRIEF DESCRIPTION OF THE DRAWINGS

This invention may be more fully described, but is not limited by the attached drawings wherein.

DESCRIPTION OF THE PREFERRED EMBODIMENTS

Figure 1:
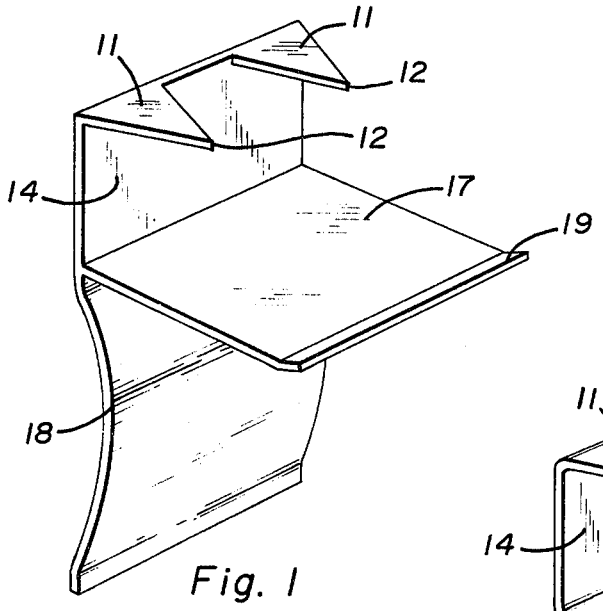
FIG. 1 is a perspective view of one embodiment of the half-clip of this invention.
Figure 2:
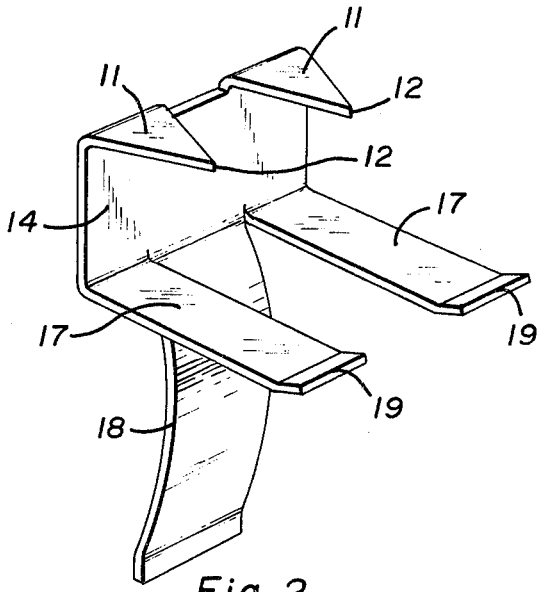
FIG. 2 is an alternative embodiment of the half-clip of this invention with the arcuately shaped spring arm being formed from the second base section.
Figure 3:
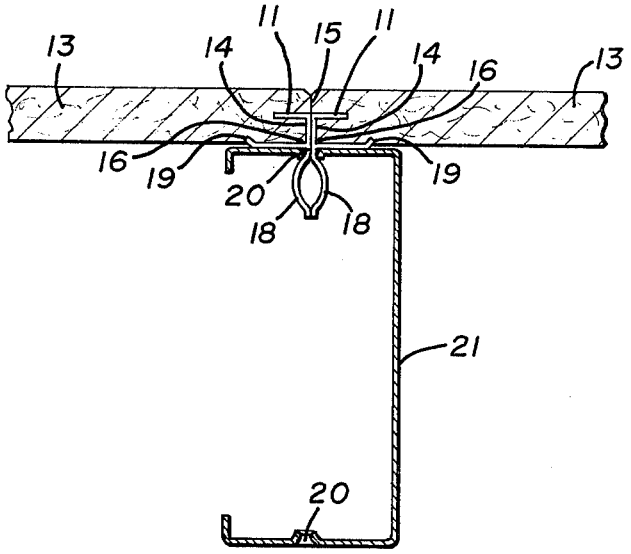
FIG. 3 is a top cross-sectional view of mounted wallboard panels using the half-clips mounted adjacent one to another to form a clip which engages a slotted stud.

The preferred embodiments of this invention are more fully described by the attached drawings wherein the Numeral 11 refers to the first shoulder section in this instance comprising one or more prongs with points 12 thereon for driving into the end of a wallboard panel 13. The first shoulder section is connected to a base section 14 extending substantially perpendicular from the shoulder section at the edge opposite the points on the prongs. When inserted in the wallboard panels at ends 15, the base section extends to the back corner 16 of the wallboard panel. At that point, a second shoulder section 17 is connected to the base section and extends substantially perpendicular to the base section and substantially parallel to and in the same direction as the first shoulder section. In addition, at the point where the corner of the wallboard is engaged, the base is extended to form a curved spring arm 18 which curves away from the first shoulder section and curves arcuately outward in the direction of the first shoulder section. As an additional improvement in the invention, the second shoulder sections of the clips have the ends 19 thereof bent inwards in order that the half-clips may grip the wallboard panels on the back face thereof. The bent sections, in attachment, force the shoulder out until it is in location and when the spring is inserted into the slot, the pressure forces the bent edges to engage the back of the panel. When the new and novel half-clips are mounted adjacent to one another on adjacently contacting wallboard panels, the half-clips form a clip having a spring-like nature for engaging a slot 20 in a stud 21 or some other such slotted support member.

When the half-clips of this invention are mounted adjacent one to the other to form a full spring clip, the insertion into the slot in the stud is made by compressing the arcuate portion of the half clips forcing them together to the point that they are essentially flat as they pass into the slot in the stud whereupon they spring back to their original shape thus securing the half-clip to the stud. It is desirable to have a small base extension extending outward the approximate distance of the width of the stud before the arcuate curve begins in order to accommodate the stud without excessive stress being placed upon the clip.

It may be seen that the new and novel half-clip of this invention as well as the wall mountings accomplished by use thereof are highly efficient systems which provide for the attachment of wallboard panels to slotted studs without damage to an exterior decorative face of the wallboard and without the need of extraneous attachment devices, such as nails, screws, brads, or the like. This new and novel system overcomes the many disadvantages of the prior art and provides a highly effective system which provides for easy and efficient installation as well as for easy and efficient removal of the panels for relocation of the walls without damage to either the wallboard or the studs. No prior known devices have accomplished this feature with the same simplicity and efficiency, and this niew and novel device uniquely provides the solution to a problem that has plagued the industry for many years.

Having fully defined this new and unique invention, the following is claimed:

1. A unique relocatable wall mounting which comprises in combination, (1) a first panel having attached thereto, (2) a first half-clip, (3) a second panel having attached thereto, (4) a second half-clip, said first and said second half-clips characterized by having, (5) first shoulder sections adapted to be driven into the respective ends of the first panel and second panel to secure them thereto, (6) base sections extending from the first shoulder sections along the ends of the panels to the outer corners of the panels, (7) second shoulder sections extending beyond the base section, said second shoulder section of said first half-clip extending along a back face of the first panel, and said second shoulder sections of said second half-clip extending along a corresponding back face of the second panel, (8) curved spring arms extending first arcuately from the base sections outward from the panels and then arcuately inward toward the base section with the curved sping arms opposing one another and acting in conjunction to form a full spring clip, and (9) a slotted support member for engaging the full spring clip formed by mounting the first panel with the first half-clip thereon end-to-end adjacent to the second panel with the second half-clip thereon and said full clip is inserted into a slot in the support member by compressing the opposing curved spring arms of the half-clips forcing them together to the point that they are essentially flat as they pass through the slot in the support member whereupon they opposingly spring back to their original arcuate shape thereby attaching the mounted panels to the slotted support member.

2. A unique relocatable wall mounting which comprises in combination, (1) a first panel having attached thereto, (2) a first half-clip, (3) a second panel having attached thereto, (4) a second half-clip, said first and said second half-clips characterized by having, (5) first shoulder sections adapted to be driven into the respective ends of the first panel and second panel to secure them thereto, (6) base sections extending from the the first shoulder sections along the ends of the panels to the outer corners of the panels, (7) second shoulder sections extending beyond the base section, said second shoulder section of said first half-clip extending along a back face of the first panel, said second shoulder sections of said second half-clip extending along a corresponding back face of the second panel, and wherein the second shoulder sections of the half-clips are bent inward to engage the respective back faces of the panels, (8) curved spring arms extending first arcuately from the base sections outward from the panels and then arcuately inward toward the base section with the curved spring arms opposing one another and acting in conjunction to form a full spring clip, and (9) a slotted support member for engaging the full spring clip formed by mounting the first panel with the first half-clip thereon end-to-end adjacent to the second panel with the second half-clip thereon and said full clip is inserted into a slot in the support member by compressing the opposing curved spring arms of the half-clips forcing them together to the point that they are essentially flat as they pass through the slot in the support member whereupon they opposingly spring back to their original arcuate shape thereby attaching the mounted panels to the slotted support member.

3. A unique relocatable wall mounting which comprises in combination, (1) a first panel having attached thereto, (2) a first half-clip, (3) a second panel having attached thereto, (4) a second half-clip, said first and second half-clips characterized by having, (5) first shoulder sections having one or more prongs with points thereon to be driven into the ends of the wall board panels to secure them thereto, (6) base sections extending from the first shoulder sections along the ends of the panels to the outer corners of the panels, (7) second shoulder sections extending beyond the base section, said second shoulder section of said first half-clip extending along a back face of the first panel, and said second shoulder sections of said second half-clip extending along a corresponding back face of the second panel, (8) curved spring arms extending first arcuately from the base sections outward from the panels and then arcuately inward toward the base section with the curved spring arms opposing one another and acting in conjunction to form a full spring clip, and (9) a slotted support member for engaging the full spring clip formed by mounting the first panel with the first half-clip thereon end-to-end adjacent to the second panel with the second half-clip thereon and said full clip is inserted into a slot in the support member by compressing the opposing curved spring arms of the half-clips forcing them together to the point that they are essentially flat as they pass through the slot in the support member whereupon they opposingly spring back to their original arcuate shape thereby attaching the mounted panel to the slotted support member.

* * * * *

UNITED STATES PATENT OFFICE

CERTIFICATE OF CORRECTION

Patent No. 4,106,251 Dated Aug 15, 1978

Inventor(s) Nels Nelsson

It is certified that error appears in the above-identified patent and that said Letters Patent are hereby corrected as shown below:

Col. 5, line 34, change "sping" to "spring".

Signed and Sealed this

*Third* Day of *July 1979*

[SEAL]

*Attest:*

*Attesting Officer*

LUTRELLE F. PARKER

*Acting Commissioner of Patents and Trademarks*